US005406814A

United States Patent [19]

Zeager et al.

[11] Patent Number: 5,406,814

[45] Date of Patent: Apr. 18, 1995

[54] DOOR LOCK SYSTEM

[76] Inventors: Michael Zeager; Cynthia M. Zeager, both of 8778 NE. Sandy Blvd., Portland, Oreg. 97220

[21] Appl. No.: 39,917

[22] Filed: Mar. 30, 1993

[51] Int. Cl.[6] ..... E05B 15/02

[52] U.S. Cl. ..... 70/102; 49/394; 49/503; 70/107; 70/131; 70/417; 70/418; 292/340; 292/346

[58] Field of Search ..... 70/416–418, 70/102–104, 131, 136, 107; 292/340, 345, DIG. 55; 49/394, 503

[56] References Cited

U.S. PATENT DOCUMENTS

| | | | |
|---|---|---|---|
| 89,931 | 5/1869 | Jones | 70/107 |
| 1,006,816 | 10/1911 | Wolfe | 70/107 |
| 1,213,827 | 1/1917 | Blume | 70/107 |
| 1,861,579 | 6/1932 | North | 49/503 X |
| 1,873,803 | 8/1932 | Wilson | 49/394 |
| 1,891,496 | 12/1932 | Bedford . | |
| 2,438,238 | 3/1948 | Tonkin | 49/394 |
| 2,801,688 | 8/1957 | Singleton | 49/394 |
| 3,761,119 | 9/1973 | Bennett et al. | 292/346 |
| 3,976,318 | 8/1976 | Krus | 292/346 |
| 3,996,774 | 12/1976 | Best | 70/32 |
| 4,130,311 | 12/1978 | Sushan | 292/346 |
| 4,139,999 | 2/1979 | Allenbaugh | 70/452 |
| 4,171,837 | 10/1979 | McRoy | 292/346 |
| 4,429,495 | 2/1984 | Aoki | 49/503 X |
| 4,458,931 | 7/1984 | McBurnie | 292/314 |
| 4,484,463 | 11/1984 | Hennessy | 70/452 |
| 4,505,504 | 3/1985 | Matzkin et al. | 292/337 |
| 4,663,950 | 5/1987 | Mascotte | 70/135 |
| 4,763,499 | 8/1988 | Boyle | 70/418 X |
| 4,887,856 | 12/1989 | Percoco et al. | 292/337 |
| 5,131,189 | 7/1992 | Mascotte | 49/460 |

FOREIGN PATENT DOCUMENTS

| | | | |
|---|---|---|---|
| 1145847 | 10/1957 | France | 49/394 |
| 11023 | 3/1903 | Germany | 70/107 |
| 352418 | 4/1922 | Germany | 70/104 |
| 3129072 | 6/1991 | Japan | 70/466 |
| 732594 | 6/1955 | United Kingdom | 70/418 |

*Primary Examiner*—Lloyd A. Gall
*Attorney, Agent, or Firm*—Kolisch, Hartwell, Dickinson, McCormack & Heuser

[57] ABSTRACT

An improved latch guarded door lock and frame system is provided. A recessed surface is provided in a hollow metal frame, and is dimensioned to accommodate a latch guard so that the external surfaces of the door, frame and latch guard are flush. The recessed surface of the frame behind the latch guard is further reinforced by employing a thicker wall than is used in the rest of the frame, and by welding a square metal tube into the recessed region. A medial metal support is also welded into the lock box cavity in order to prevent the lock box from collapsing under stress. The resulting door lock and frame system is less penetrable than prior systems, and provides greater security because the latch guard is less vulnerable to prying and because the frame and lock box are reinforced, thus less likely to collapse under stress.

10 Claims, 1 Drawing Sheet

DOOR LOCK SYSTEM

FIELD OF THE INVENTION

The invention relates to door locks. In particular, the invention involves break-in resistant devices for use in steel door lock and frame systems. The invention provides a high-security door system which is harder to break into and more aesthetically attractive than prior security door systems.

BACKGROUND OF THE INVENTION

In recent years there has been an increased need for break-in resistant exterior door locking systems, particularly in urban areas where crime rates have increased dramatically.

A typical security door lock system includes at least one deadbolt which is extendable from a door through an aperture in a hollow metal door frame by inserting and rotating a matched key. One of the most common ways for a thief to break into such a lock, is by inserting a prying tool between the door and the frame for the purpose of dislodging the bolt from the frame cavity. In an attempt to prevent this type of break-in, many door manufacturers or builders today provide an exterior door with a "latch guard" attached to the door and extending over a portion of the frame when the door is closed. The primary purpose of the latch guard is to block the opening between the door and the frame in the vicinity of the lock. While the latch guard has been partially successful for the purpose of preventing or deterring break-ins, it also is susceptible to being pried open.

This problem was addressed by Mascotte in U.S. Pat. No. 5,131,189 which discloses an "antiprying member" consisting of a metal plate attached to the external surface of the frame surrounding the latch guard. There are, however, several notable problems with the Mascotte antiprying member.

First, Mascotte's antiprying plate protrudes beyond the surfaces of the door and frame, and therefore detracts from the aesthetic appearance of the entire door lock and frame system.

Second, since the antiprying member sits on top of the external frame surface, it accommodates a door having a latch guard which also protrudes out from the external door surface, further detracting from the aesthetic quality of the entire system.

Third, one of the reasons that a typical latch guard is susceptible to prying is that the door frame wall below the latch guard is collapsible. Mascotte's antiprying member does not add any extra strength to the frame wall disposed behind the latch guard.

Accordingly, it is an object of the present invention to provide a door lock system in which a latch guarded lock is provided in a door frame system in which all of the external surfaces of the door, frame and latch guard are flush.

Another object is to provide a door lock and frame system in which the region of the door frame which is covered by the latch guard, is reinforced to prevent collapse.

Another object of the invention is to provide a door lock system in which the box surrounding the lock ("lock box") is reinforced to prevent collapse.

SUMMARY OF THE INVENTION

The objectives stated above and other important objectives are accomplished with the present invention which includes a hollow metal frame having a principal surface on a front wall and a recessed surface set back from the principal surface. A door is hinged within the frame and a planar latch guard is attached to the door and extendable over the recessed portion of the frame so that when the door is shut the latch guard is substantially flush with the front surface of the frame, thus providing an aesthetically attractive latch guarded door lock and frame system which is difficult to break into.

In a preferred embodiment, the recessed surface is part of a rectangular or square tube welded into the frame. The tube has a thicker wall than the frontal wall of the frame. The thicker wall and tubular geometry in the recessed area of the frame provides significantly greater strength and stability for resisting attempts to break into the lock by prying around the latch guard.

In another aspect of the invention, a medial support wall is welded across the interior cavity of the lock box in order to prevent the lock box from collapsing under stress.

DETAILED DESCRIPTION OF THE PREFERRED EMBODIMENTS

Figure 1:
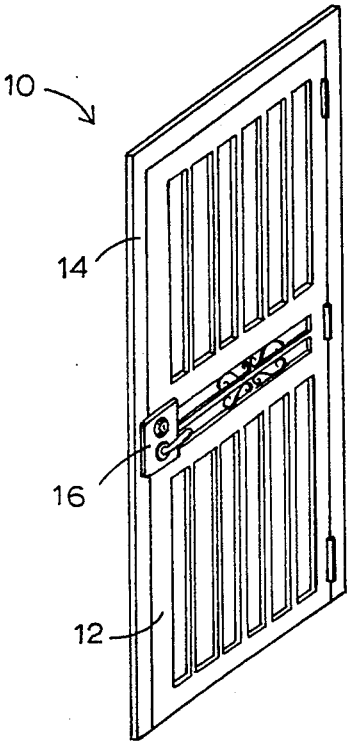
FIG.1 PRIOR ART
FIG. 1 is a perspective view of a door lock and frame system in the prior art.

FIG. 1 shows a prior art door, frame and lock system 10 including a door 12 hinged within a frame 14. A latch guard 16 is provided on the door 12. The latch guard 16 extends over a portion of the frame 14 when the door 12 is closed for the purpose of preventing a person from prying between the door 12 and the frame 14 in the vicinity of the lock and latch. In the prior art system the front surfaces of the frame 14 and the door 12 are typically flush, and the latch guard 16 conspicuously sits on top of those surfaces, thereby detracting from the overall aesthetic appearance of the door.

Figure 2:
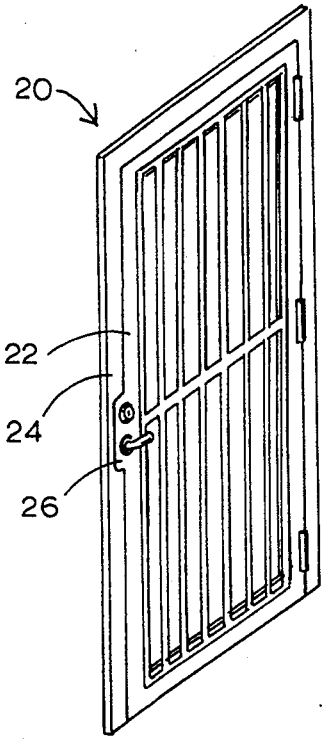
FIG. 2 is a perspective view of a door lock and frame system in accordance with a preferred embodiment of the present invention.

In contrast, FIG. 2 shows a door, frame and lock system 20 in a preferred embodiment of the present invention including a door 22 hinged within a frame 24. The latch guard 26 is integrated into the door 22 so that no seams around the latch guard or lock box are visible. As will be more clearly illustrated in the subsequent drawings, the latch guard 26 is accommodated within a recess in the frame 24 so that the front surfaces of door 22, frame 24, and latch guard 26 are all flush, thus producing a more aesthetically attractive door, frame and lock system. Another important advantage of the door system shown in FIG. 2, is that, since the latch guard 26 sits within a recess in the frame, it is more difficult for a person to insert a prying tool between the latch guard 26 and the frame 24, thus producing a more secure system.

Figure 3:
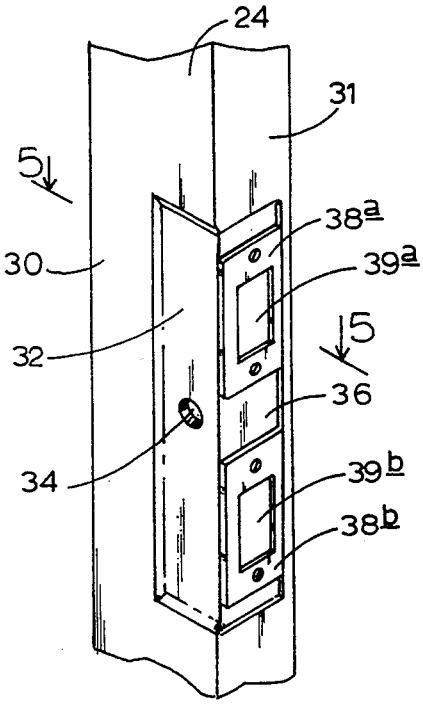
FIG. 3 is a partial perspective view illustrating recessed portions of the frame in a preferred embodiment of the present invention.

FIG. 3 illustrates further details of the frame 24 in a preferred embodiment of the present invention. The frame 24 has a principal surface on a front wall 30 and an interior surface on an interior wall 31. A recessed surface 32 is provided in the front wall 30 and is dimensioned to accommodate the latch guard 26 of the door 22. An aperture 34 is provided in the recessed surface 32 for receiving a pin which protrudes perpendicularly from the latch guard, as shown in the subsequent figures.

A second recessed surface 36 is provided in the interior wall 31. Strike plates 38*a* and 38*b* are secured onto the second recessed surface 36. The strike plates 38*a* and 38*b* have apertures 39*a* and 39*b* respectively, which extends through the second recessed surface 36 in the interior wall 31 respectfully, for receiving deadbolts and/or latch members.

Figure 4:
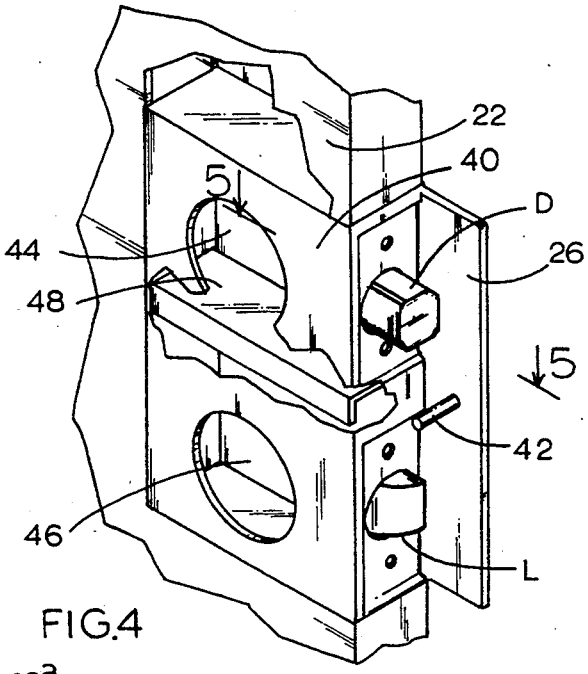
FIG. 4 is a partial perspective cut-away view of a lock box and latch guard in a preferred embodiment of the present invention.

FIG. 4 shows a lock box 40 integrated into a door 22. The lock box 40 is typically provided with latch guard 26 and perpendicularly protruding pin 42 which inserts into aperture 34 in the first recessed surface 32 of the front wall 30, when the door is closed. The pin 42, when inserted into the aperture 34 of the frame 24, helps to prevent separation of the deadbolt latch from the frame. Holes 44 and 46 are provided in the lock box for accommodating lock and/or latch assemblies.

It has been discovered that one of the weaknesses in prior art doors, is that the lock box 40 is susceptible to collapse under stress allowing a person to break through the locked door. An important feature of the present invention includes a U-shaped steel support 48 which is welded into the lock box, as shown in FIG. 4, so that the lock box is separated into two discreet chambers, each chamber being available to house a lock or latch assembly. Preferably, the steel support is $1\frac{1}{4}'' \times \frac{1}{2}'' \times \frac{1}{8}''$. Support structure 48 significantly increases the strength of the box for the purpose of resisting collapse from pounding or prying. Without such a support, if the lock is pounded with a hammer, and the lock doesn't give way, the lock box begins to crush allowing access to the inner workings of the deadbolt. The medial center support 48 prevents the lock box from collapsing.

Figure 5:
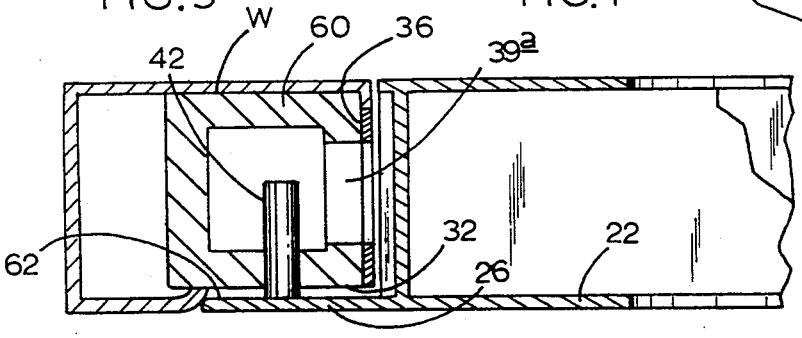
FIG. 5 is a partial cross-sectional view illustrating the relationship between a latch guard and reinforced frame when the door is closed in a preferred embodiment of the present invention.

FIG. 5 shows a cross sectional view of the components shown in FIGS. 3 and 4 when the door is closed. The front surfaces of the door, frame and latch guard are all flush. The recessed surfaces 32 and 36 of the frame 24 are reinforced by welding W a steel tube 60 into the frame 24 in the vicinity of the lock. The tube 60 supplies the recessed surfaces 32 and 36 of the frame 24. The thickened walls and geometric shape of the tube 60 provide significantly greater strength to the recessed surfaces 32 and 36, thus resisting collapse from pounding or prying, and resulting in a lock system which is substantially more difficult to break into than prior lock systems.

In the preferred embodiment, the tube 60 has a square cross-section and each wall has a width of $1\frac{1}{4}''$. The thickness of the tube walls is $\frac{1}{4}''$. Whereas, the thickness of the walls of the frame 24 and the door 22 are less than 3/32". Thus, the tube wall is more than twice as thick as the other walls employed in the door and frame system. The width of the interior wall 31 of the frame 24 is $1\frac{1}{2}''$. The depth of the recessed surface 32 is preferably slightly greater than the thickness of the latch guard 26 so that there is a small gap 62 between the latch guard 26 and the recessed surface 32 of approximately 1/16". Holes 39*a* and 39*b* are provided in the tube 60 for receiving deadbolts and/or latch members.

A high-security deadbolt D lock, such as a maximum security deadbolt available from KWIKSET TM, Series 885, is installed into the upper chamber of the lock box and a suitable manually operable door knob or latch L is installed into the lower chamber of the lock box.

A detailed description and illustrations of the preferred embodiments have been provided. However, it is intended that the claimed invention include other variations and modifications of the described embodiments which are within the scope and spirit of the invention as set forth in the claims below.

I claim:

1. A door lock system comprising:

a hollow metal frame having a principal surface on a front wall and at least one aperture on an interior wall;

a door hinged to the frame and including a deadbolt extendable into the aperture of the frame wherein the door has a length-wise principal edge, visible from front view, and juxtaposed with the interior wall of the frame when the door is closed; and a planar latch guard on the door covering the deadbolt and extended beyond the principal edge of the door over a guarded area of the principal surface of the frame, the guarded area having a first recessed surface setback from the principal surface and dimensioned to receive the latch guard so that when the door is shut the latch guard is flush with the door and the principal surface of the frame, wherein the latch guard has a pin projecting perpendicularly from the latch guard toward the frame, and the guarded area of the frame has a second aperture for receiving the pin when the door is closed, thus providing an aesthetically attractive highly secure latch guarded door lock and frame system.

2. The system of claim 1 wherein the interior wall of the frame has a second recessed surface contiguous with the first recessed surface, onto which a lock strike can be mounted.

3. The system of claim 2 wherein the first and second recessed surfaces are reinforced relative to the rest of the frame.

4. The system of claim 1 wherein the deadbolt is contained within a lock box housed within the door behind the latch guard, the lock box including a first chamber for housing the deadbolt adjacent to a second chamber for housing a latch member, wherein the first and second chambers are separated by a steel support for preventing collapse of the lock box under stress.

5. A door lock system comprising:

a hollow metal frame having a principal surface on a front wall and at least one aperture on an interior wall;

a door hinged to the frame and including a deadbolt extendable into the aperture of the frame; and a planar latch guard on the door covering the deadbolt and extendable over a guarded area of the principal surface of the frame, the guarded area having a first recessed surface setback from the principal surface and dimensioned to receive the latch guard so that when the door is shut the latch guard is flush with the door and the principal surface of the frame, thus providing an aesthetically attractive highly secure latch guarded door lock and frame system;

wherein the interior wall of the frame has a second recessed surface contiguous with the first recessed surface, onto which a lock strike can be mounted, and further comprising a tube welded into the door frame, wherein the first and second recessed surfaces are on the tube.

6. A door lock system comprising:

a hollow metal frame having a principal surface on a front wall and at least one aperture on an interior wall;

a door hinged to the frame and including a deadbolt extendable into the aperture of the frame; and a planar latch guard on the door covering the deadbolt and extendable over a guarded area of the principal surface of the frame, the guarded area having a first recessed surface setback from the principal surface and dimensioned to receive the latch guard so that when the door is shut the latch guard is flush with the door and the principal surface of the frame, wherein the first recessed surface is on a steel tube welded into the frame, the tube having a thicker wall than the front wall of the frame thus providing an aesthetically attractive highly secure latch guarded door lock and frame system.

7. The system of claim 6 wherein the thickness of the tube wall is $\frac{1}{4}$ inch

8. The system of claim 6 wherein the tube has a square cross section.

9. The system of claim 6 wherein the tube has four walls, each wall having a width of approximately $1\frac{1}{4}$ inch.

10. A door lock system comprising:

a hollow metal frame having a principal surface on a front wall and at least one aperture on an interior wall;

a door hinged to the frame and including a deadbolt extendable into the aperture of the frame; and a planar latch guard on the door covering the deadbolt and extendable over a guarded area of the principal surface of the frame, the guarded area having a first recessed surface set back from the principal surface and dimensioned to receive the latch guard so that when the door is shut, the latch guard is flush with the door and the principal surface of the frame and having a second recessed surface contiguous with the first recessed surface, onto which a lock-strike can be mounted, wherein the first and second recessed surfaces are reinforced relative to the rest of the frame so that the thickness of the walls behind the recessed surfaces are greater than the thickness of the front and interior walls of the frame, thus providing an aesthetically-attractive, highly-secure, latch-guarded door lock and frame system.

* * * * *